United States Patent [19]

Fontlladosa

[11] 4,253,561

[45] Mar. 3, 1981

[54] DISPLAY UNIT FOR CONFECTIONERIES

[76] Inventor: Enrique B. Fontlladosa, 184, Paris St., Barcelona, Spain

[21] Appl. No.: 65,046

[22] Filed: Aug. 9, 1979

[30] Foreign Application Priority Data

Apr. 18, 1979 [ES] Spain ..... 243.169

[51] Int. Cl.[3] ..... B65D 5/50

[52] U.S. Cl. ..... 206/44 R; 206/477; 206/564; 211/71; 248/133

[58] Field of Search ..... 206/44 R, 44.11, 45, 206/564, 565, 471; 211/71, 84, 175; 248/128, 133

[56] References Cited

U.S. PATENT DOCUMENTS

| | | | |
|---|---|---|---|
| 2,575,809 | 11/1951 | Hankins | 211/71 |
| 2,592,496 | 4/1952 | Vigh | 248/128 |
| 3,192,970 | 7/1965 | Allen | 71/211 |
| 3,216,560 | 11/1965 | Goldstein | 206/44 R |
| 4,193,351 | 3/1980 | Belokin, Jr. | 206/44 R |

FOREIGN PATENT DOCUMENTS

| | | | |
|---|---|---|---|
| 1450094 | 7/1966 | France | 206/44 R |

*Primary Examiner*—Joseph Man-Fu Moy

*Attorney, Agent, or Firm*—Wenderoth, Lind & Ponack

[57] ABSTRACT

A display unit for confectioneries includes two symmetrical elements defining planes connected to each other by means of cross-members, each formed by pairs of pins or shanks coupled together coaxially. The planes are larger on the upper part of the display unit to form a large surface allowing the insertion of graphics for identifying the product to be shown. The planes are larger at the lower part of the display unit and are provided with bent portions.

1 Claim, 8 Drawing Figures

DISPLAY UNIT FOR CONFECTIONERIES

The present Utility Model deals with a display unit for confectioneries.

The invention relates concretely to a exposure device specially destined to sweets, as candies at the end of a radial stick, i.e. lollipops.

The display unit as referred to includes two main elements defined as follows:

(1) a structural frame, (2) a plurality of containers for the product to be shown.

The before mentioned frame comprises a vertical structure formed by two walls or sides related each other by crossmembers to support the container elements which self-orient these to an identical angle.

The cited containers consist in a cover and base which make them suitable for the transport of the product being possible to be engaged to the support at the point of exposition.

The invention will now be described by way of example with reference to the accompanying drawings in which:

FIG. 1 shows a perspective view of the structural frame integrating the referred display unit.

FIGS. 2 and 3 correspond to a lateral and frontal view of one side of the display unit.

Figure 1:
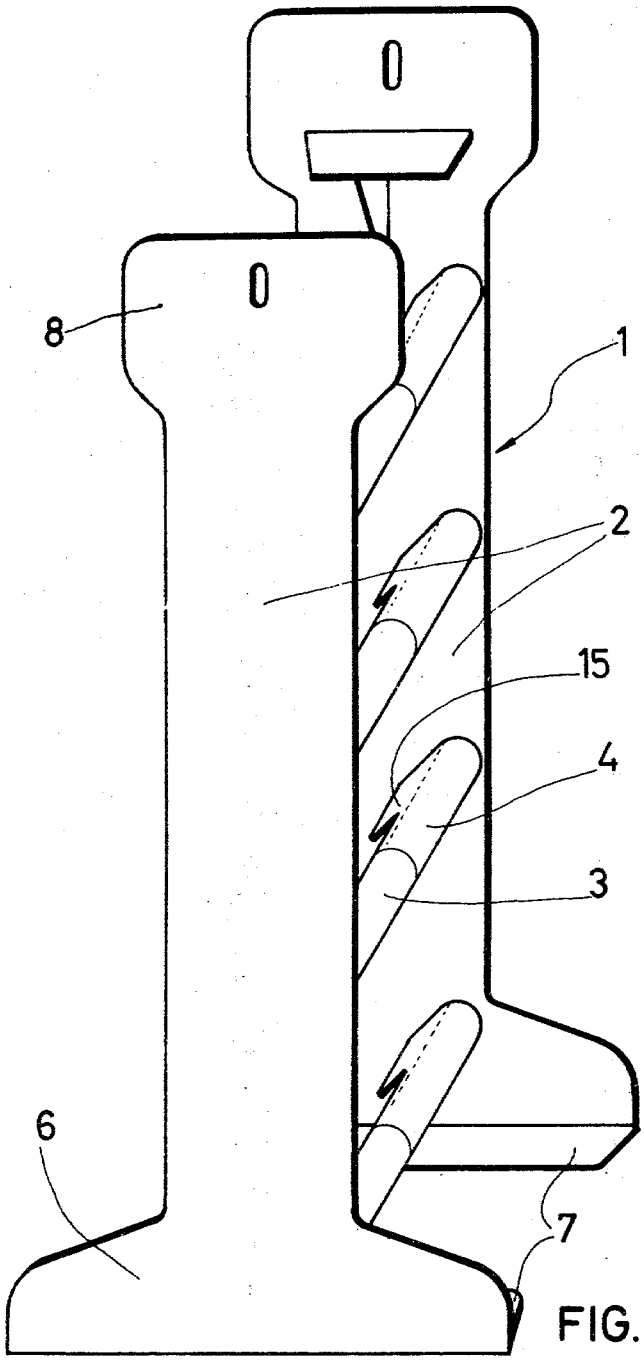
Figures 2, 3:
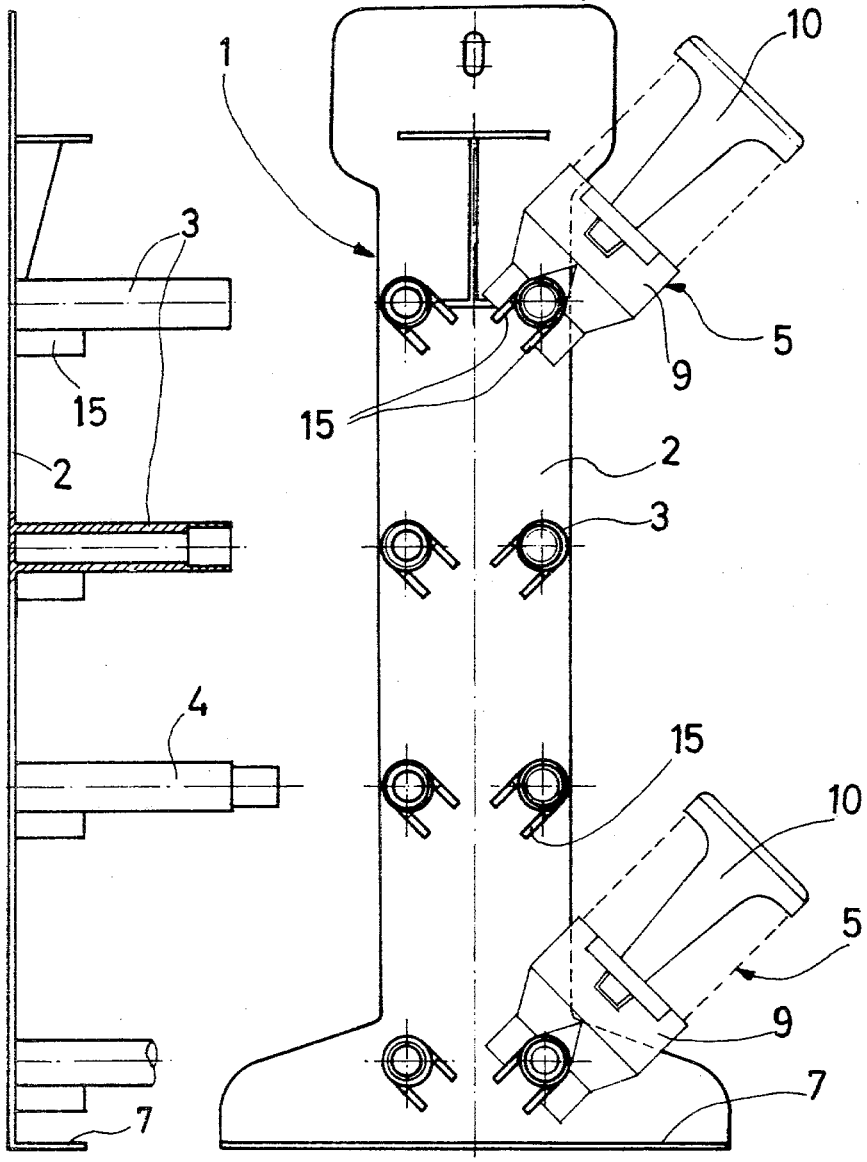
Figure 4:
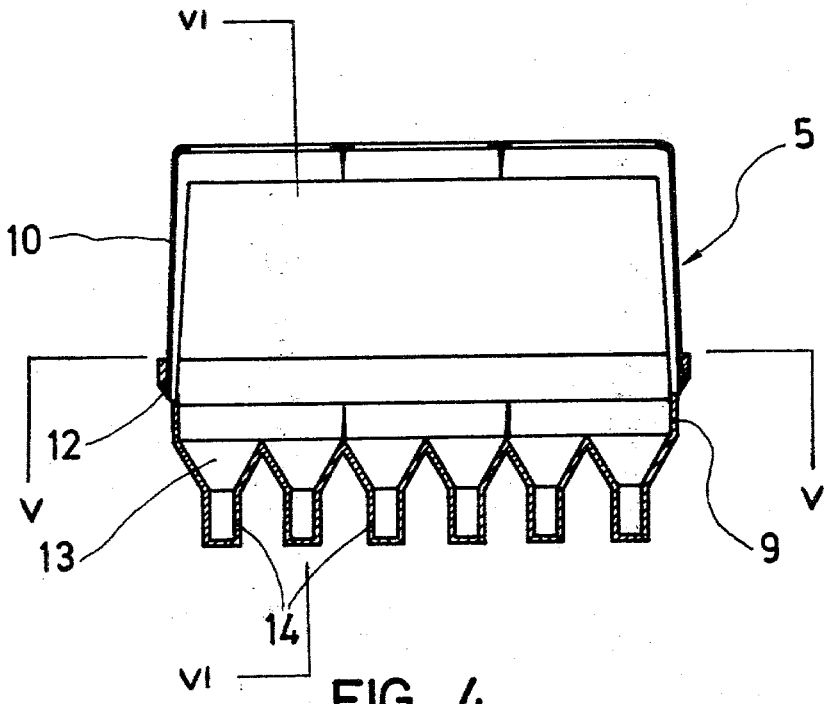
FIGS. 4 and 5 are views of a container in a longitudinal end view and a cross plan view in section V—V.
Figure 5:
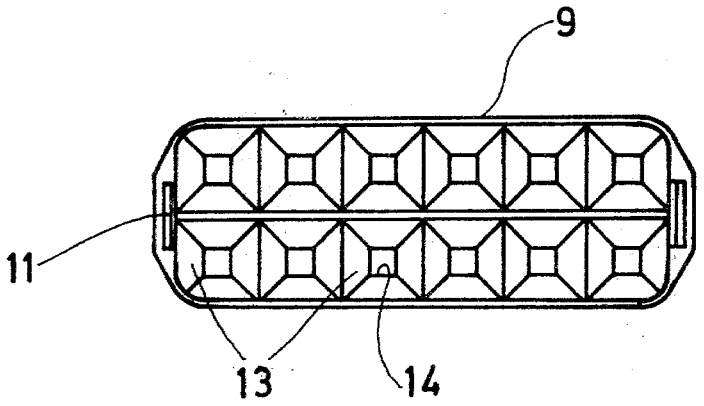
Figure 6:
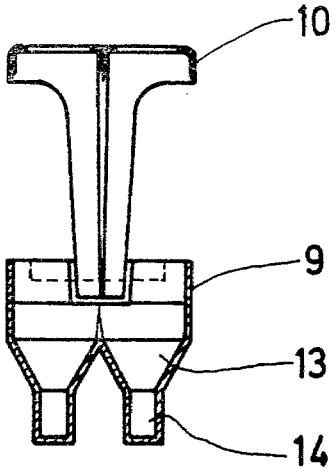
FIGS. 6 and 7 are upper plan views of a container as to the section VI—VI.
Figure 8:
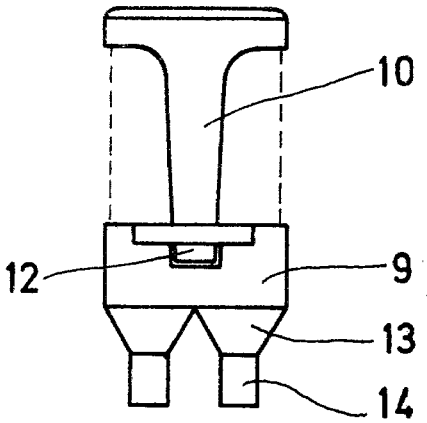
FIG. 8 is a lateral elevational view of the container of the product.
Figure 7:
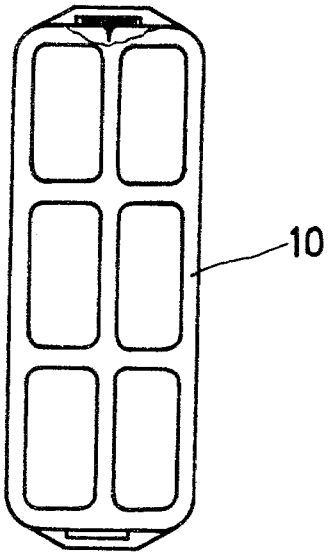

Reference is now made to the drawings appreciating in the embodiment a display unit for confectioneries which structural frame generally designated with 1 is being composed of two symmetrical pieces or sides 2 of variable thickness and shape, fastened by means of the cross-members 3 and 4 belonging to each side 2 which are coupled together in a tongued or grooved way. These cross-members 3 and 4 are the support for the containers of the good generally designated with 5.

The laterals 2 are getting enlarged at the lower part as to 6, presenting a 90° degree doubling 7, constituting the base of the sustentation of the assembly.

Concerning the upper part, sides 2 are getting larger as to 8 to allow the insertion of drawings or graphicals for identifying the product as exposed.

The mentioned display unit is preferably made from injected plastic material, presenting the features of being formed by two equal pieces 2 symmetrically related in a 180° degree gyration, realising this connection by means of female and tap pins which form the cross-members 3-4, which once assembled constitute a solidary embodiment.

The display unit 1 is completed with two containers generally designated with 5, comprising a support of prismatic form 9 and fork-like cover 10 cramping with the support 9 thanks the side orifices 11 receiving the harpoon recesses 12 of the cover, forming this container the packaging of the product, usable for the transport and connectable to the support 1 at the exposition point.

The support or base 9 shows projections in the form of a quadrangular pyramid 13 truncated by a prism 14 allowing the self-centering of the product to be exposed, as well as its permanent exposition.

When withdrawing the cover 10 liberating the projections 12 of the orifices 11, the product remains free.

The cross-members 3 and 4 show flat extremes 15 for placing the containers 5 into the inclined position.

What we claim is:

1. A display unit for confectioneries, preferably destined to candies in the form of a lump on the end of a stick, i.e. a lollipop, characterised by comprising two symmetrical elements integrating planes related each other by means of crossmembers formed each one by pairs of pins or shanks respectively belonging to the inner side of each lateral and which pins are coupled together coaxially in a tongued way; as planes integrating the display unit are getting larger on the upper part to form a large surface allowing the insertion of graphicals for identifying the product to be shown; in that said planes are getting larger at the lower part, being providd with a bent portion towards the inner side, forming the base of sustentation of the assembly; in that the cross-members relating solidarily both planes constitute the supporting means for container devices of the product integrated by a prismatic shaped base and a fork-like cover engaged with the base to form the packaging of the product; in that the cited base shows some projections in the way of a pyramide truncated by a prism receiving the end of the stick, self-centering the product to be exposed; in that said base disposes of two lateral orifices to engage into some harpoon recesses of the cover remaining the product located between the base and the cover; in that the container device as described is used for transporting the product, being possible to engage it with the display unit at the exposition point by means of adjustment of the projections of the base with the cross-members which present end planes positioning the containers automatically into the inclined position of an identical ngle.

* * * * *